United States Patent [19]

LePon

[11] 4,127,072

[45] Nov. 28, 1978

[54] MODULAR SHELF

[76] Inventor: Waleigh J. LePon, 217 S. Highland, Ames, Iowa 50010

[21] Appl. No.: 824,718

[22] Filed: Aug. 15, 1977

[51] Int. Cl.[2] ..... A47B 45/00

[52] U.S. Cl. ..... 108/111; 108/153

[58] Field of Search ..... 108/111, 101, 114, 153, 108/56.1, 56.3, 157, 53.5, 91

[56] References Cited

U.S. PATENT DOCUMENTS

| | | | |
|---|---|---|---|
| 1,538,393 | 5/1925 | Fowler | 108/101 |
| 2,083,997 | 6/1937 | Kahan | 108/114 |
| 2,654,487 | 10/1953 | Degener | 108/91 X |
| 2,897,571 | 8/1959 | Kupchinsky | 108/111 |
| 2,919,817 | 1/1960 | Maslow | 108/111 |
| 2,935,283 | 5/1960 | Berry | 108/53.5 |
| 3,669,033 | 6/1972 | Murcia | 108/153 |
| 3,695,190 | 10/1972 | Bucholz | 108/111 |

FOREIGN PATENT DOCUMENTS

| | | | |
|---|---|---|---|
| 887,646 | 8/1943 | France | 108/111 |

*Primary Examiner*—Francis K. Zugel

*Attorney, Agent, or Firm*—Zarley, McKee, Thomte, Voorhees & Sease

[57] ABSTRACT

The present invention comprises a plurality of horizontal components and a plurality of vertical components which may be interlocked together to provide shelving. The horizontal components have upwardly and downwardly presented ribs which are adapted to be received in the edges of the vertical assembly to lock the two components together.

6 Claims, 6 Drawing Figures

MODULAR SHELF

SUMMARY OF THE INVENTION

The shelf comprises a plurality of horizontal assemblies and a plurality of vertical assemblies which may be interlocked to provide rectangular shelving.

The primary object of the present invention is the provision of modular shelving which may be easily assembled and which once assembled will provide sturdy shelving for the support of heavy objects such as books and the like.

A further object of the present invention is the provision of modular shelving which utilizes two basic different types of components.

A further object of the present invention is the provision of modular shelving which is inexpensive and yet which provides sturdy and attractive shelving.

A further object of the present invention is the provision of modular shelving which may be assembled into numerous shapes and sizes which will accommodate the user's needs for shelving.

A further object of the present invention is the provision of modular shelving which is economical to manufacture, durable in use and attractive in appearance.

DETAILED DESCRIPTION OF THE DRAWINGS

Figure 1:
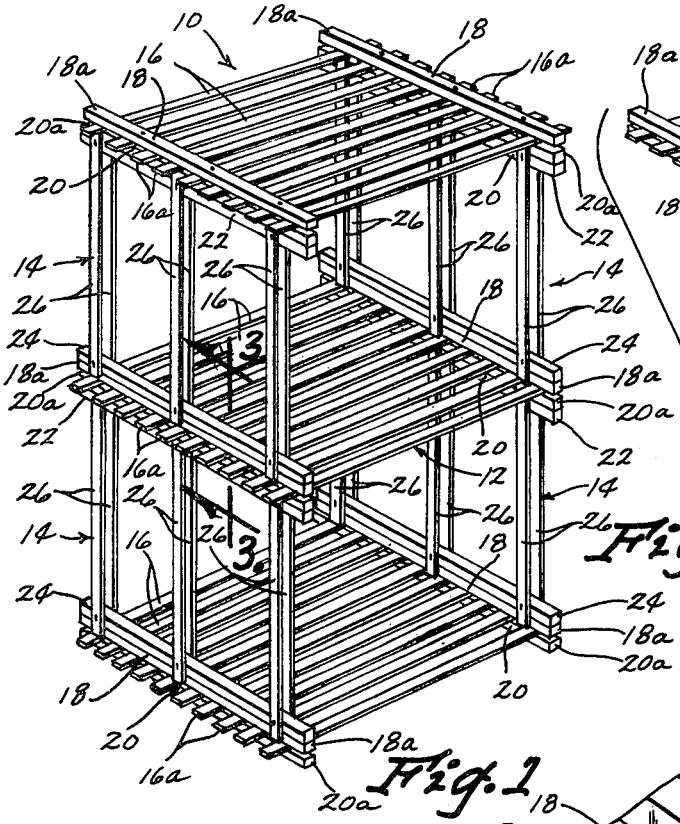
FIG. 1 is a perspective view of shelving made with the modular components of the present invention.

The numeral 10 generally designates the shelf configuration shown in FIG. 1. Shelf 10 includes three horizontal shelf assemblies 12 which are identical in construction and four vertical support assemblies 14 which are identical in construction.

Horizontal shelf assembly 12 comprises a plurality of spaced apart slats 16 each of which is of the same width. Slats 16 are held together by a pair of upwardly presented transversely extending ribs 18 and a pair of downwardly presented transversely extending ribs 20. Ribs 18–20 are in vertical registered alignment with one another, and embrace the opposite sides of slats 16. Ribs 10 and 20 are located a short distance inwardly from the opposite ends of slats 16 so that the ends of slats 16 protrude outwardly a short distance beyond ribs 18–20. Similarly, the opposite ends of ribs 18, 20 protrude beyond slats 16 a short distance.

Figure 2:
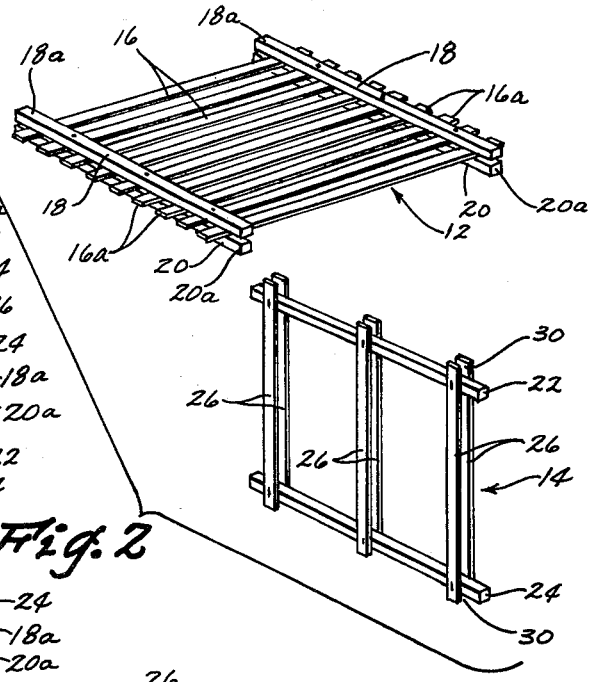
FIG. 2 is a perspective view of the two components of the present invention.

Vertical support assembly 14 comprises an upper horizontal member 22, a lower horizontal member 24, and a plurality of vertical spaced apart support members 26. Support members 26 are arranged in pairs on opposite sides of horizontal support members 22–24 as shown in FIG. 2. The upper ends of support members 26 extend above horizontal member 22, and the lower ends of support members 26 extend below horizontal support members 24. The upper and lower ends of support members 26 form a groove or slot generally designated by the numeral 30 which is sized to receive either downwardly presented rib 20 or upwardly presented rib 18.

Figure 4:
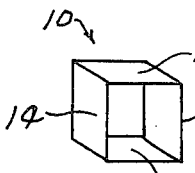
FIGS. 4, 5 and 6 illustrate various configurations which may be built with the components of the present invention.
Figure 5:
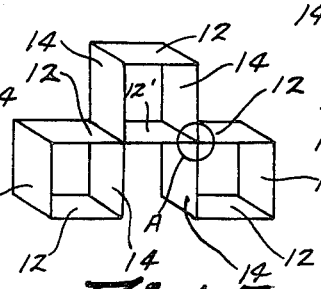
Figure 6:
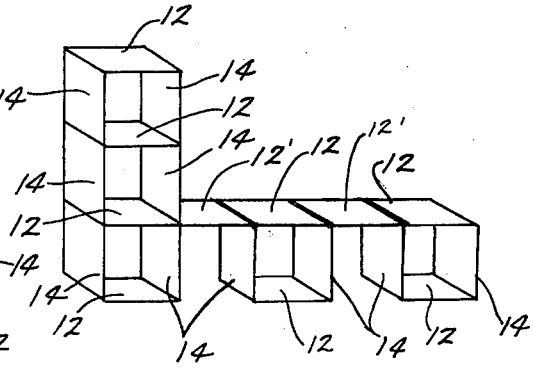

The two assemblies 12 and 14 can be assembled into numerous configurations. FIGS. 4, 5 and 6 illustrate some of the configurations which may be constructed from these two components. FIG. 4 illustrates the basic rectangular shelf which is constructed from two horizontal assemblies 12 and two vertical assemblies 14. FIG. 5 illustrates two such rectangular shelves spaced apart from one another with a third rectangular shelf straddling the space therebetween. FIG. 6 illustrates an even further configuration wherein the rectangular components are arranged in an L-shaped type of shelf. From the foregoing, it can be seen that the shelves may be arranged in an infinite variety of configurations.

Figure 3:
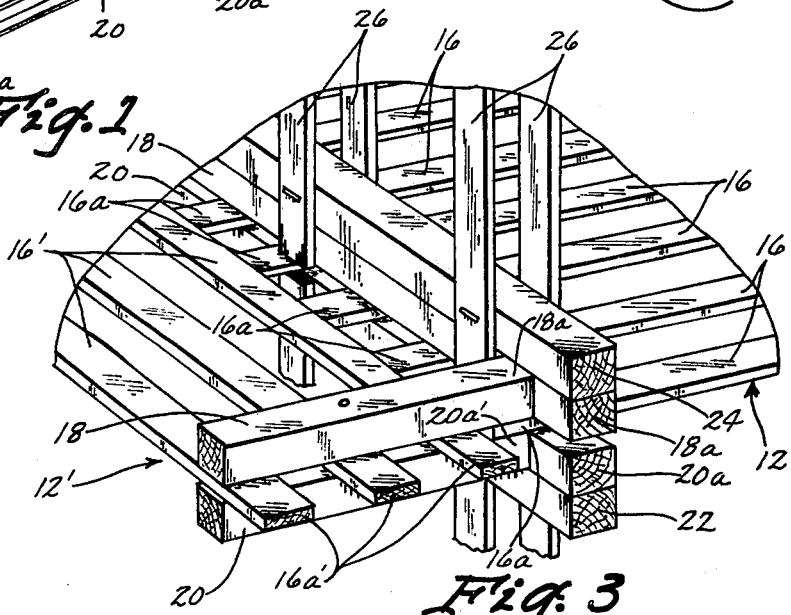
FIG. 3 is a perspective view of a corner joint of the modular shelf of the present invention such as shown in circle A of FIG. 5.

FIG. 3 illustrates a joint such as the joint shown in Circle A of FIG. 5. Upwardly presented rib 18 is aligned with lower horizontal member 24 and is fitted within groove 30 between the two spaced apart support members 26 so as to lock assembly 12 to the upwardly extending vertical assembly 14. Downwardly presented rib 20 is aligned with upper horizontal member 22 of a second vertical assembly and is fitted within groove 30 between the two spaced apart support members 26 so as to lock horizontal assembly 12 to a second vertical assembly 14 located therebelow.

A second horizontal assembly 12' may be attached to the joint also to create a configuration such as shown in FIG. 5. Assembly 12' is rotated 90° from the orientation of assembly 12. The protruding ends **18*a*' and 20*a*' of ribs 18', 20' are slipped over the protruding ends 16*a* of the two outside slats of assembly 12, thereby interlocking assembly 12' to assembly 12. This joint permits assembly 12' to span the distance between two rectangular shelves such as shown in FIG. 5**.

The modular shelving of the present invention may be easily assembled, and once assembled provide sturdy shelving for the support of heavy objects such as books or the like. It has been found that the shelves of the present invention may be stacked vertically upon one another, and that after stacking will support the weight of a person standing or sitting thereon. The modular shelving of the present invention utilizes two basic types of components, and therefore simplifies the construction process. The components of the invention are inexpensive to construct, and yet they are sturdy and provide attractive shelving. They may be assembled into numerous shapes and sizes which will accommodate the user's need for shelving. Thus, it can be seen that the device accomplishes at least all of its stated objectives.

What is claimed is:

1. A modular shelf comprising:

at least two spaced apart vertical support assemblies, each of said vertical support assemblies comprising elongated upper and lower horizontal members spaced vertically apart from one another, a first pair of vertical members spaced apart from one another and embracing said upper and lower horizontal members therebetween, a second pair of spaced apart vertical members embracing said upper and lower horizontal members therebetween, said upper horizontal member being operatively secured to said first and second pairs of members at a point spaced downwardly from the upper ends of said vertical members so as to form a U-shaped channel with said upper ends of said vertical members, said lower horizontal member being operatively secured to said first and second pairs of vertical members so as to form an inverted U-shaped channel with said lower ends of said vertical members, said first pair of vertical members being spaced horizontally from said second pair of vertical members so as to combine with said upper and lower horizontal members to create a rectangular configuration, an upper horizontal support assembly extending between said spaced apart vertical support assemblies, said upper horizontal support assembly having two downwardly presented horizontal ribs, each of which is in registered alignment with one of said horizontal members of said vertical support assemblies, said downwardly presented ribs being slidably retentively fitted within said U-shaped channels of said vertical support assemblies;

a lower horizontal support assembly extending between said spaced apart vertical assemblies, said lower horizontal support assembly having upwardly presented horizontal ribs, each of which is in registered alignment below one of said lower horizontal members of said vertical support assemblies, said upwardly presented ribs being slidably retentively embraced within said inverted U-shaped channels of said vertical support assemblies, said upper and lower horizontal assemblies each having a plurality of elongated slats extending transversely to said ribs, said horizontal ribs being secured to said slats at points spaced inwardly from the opposite ends of said slats, all of said slats being spaced inwardly from the opposite ends of said horizontal ribs.

2. A modular shelf according to claim 1 wherein said upper and lower horizontal assemblies are identical in construction each having a pair of upwardly presented ribs and a pair of downwardly presented ribs.

3. A modular shelf according to claim 2 wherein said pair of upwardly presented horizontal ribs and said pair of downwardly presented horizontal ribs are in vertical spaced apart registered alignment.

4. A modular shelf according to claim 3 wherein said slats extend transversely to said ribs through the space between said upwardly and downwardly presented ribs.

5. A modular shelf according to claim 4 wherein a third horizontal assembly identical in construction to said first mentioned horizontal assemblies is operatively attached to one of said first mentioned horizontal assemblies, said ends of at least two of said slats of said one horizontal assembly protruding between said spaced apart ends of said upper and lower ribs of said third horizontal assembly.

6. A modular shelf according to claim 7 wherein said slats of said third assembly are transversely oriented with respect to said slats of said one horizontal assembly.

* * * * *